US008142143B2

(12) United States Patent
Kreiselmaier et al.

(10) Patent No.: US 8,142,143 B2
(45) Date of Patent: Mar. 27, 2012

(54) GUIDE VANE FOR A GAS TURBINE

(75) Inventors: Erich Kreiselmaier, Stetten (CH); Jose Anguisola McFeat, Lauchringen (DE); Christoph Nagler, Zurich (CH); Sergei Riazantsev, Stetten (CH); Brian Kenneth Wardle, Brugg-Lauffohr (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 12/884,851

(22) Filed: Sep. 17, 2010

(65) Prior Publication Data

US 2011/0070089 A1 Mar. 24, 2011

Related U.S. Application Data

(63) Continuation of application No. PCT/EP2009/051969, filed on Feb. 19, 2009.

(30) Foreign Application Priority Data

Mar. 19, 2008 (CH) ..... 417/08

(51) Int. Cl.
*F04D 29/54* (2006.01)

(52) U.S. Cl. ..... 415/191; 415/209.2

(58) Field of Classification Search ..... 415/134, 415/191, 208.1, 209.2, 209.3
See application file for complete search history.

(56) References Cited

U.S. PATENT DOCUMENTS 3,628,880 A 12/1971 Smuland et al.
4,573,865 A 3/1986 Hsia et al.
4,687,413 A * 8/1987 Prario ..... 415/190
4,820,116 A 4/1989 Hovan et al.
5,201,846 A 4/1993 Sweeney
5,454,220 A 10/1995 Althaus et al.
6,062,813 A 5/2000 Halliwell et al.
6,951,447 B2 * 10/2005 Cherolis et al. ..... 416/193 A
2004/0018082 A1 1/2004 Soechting et al.

(Continued)

FOREIGN PATENT DOCUMENTS

DE 2004 004 014 A1 8/2005

(Continued)

OTHER PUBLICATIONS

International Search Report (PCT/ISA/210) issued on Aug. 4, 2009, by European Patent Office as the International Searching Authority for International Application No. PCT/EP2009/051969.

(Continued)

*Primary Examiner* — Nathaniel Wiehe
(74) *Attorney, Agent, or Firm* — Buchanan Ingersoll & Rooney PC

(57) ABSTRACT

A stator blade for a gas turbine includes a blade airfoil extending in a longitudinal direction of the blade and is delimited by leading and trailing edges. The stator blade includes a shroud, whose inner side is exposed to hot gas which flows through the gas turbine. A hook-like fastening element for fastening the stator blade on a casing of the gas turbine projects outwards in the region of the trailing edge. The fastening element has a locating slot above the trailing edge for fixing a heat shield, which is connected to the shroud in the flow direction of the hot gas. A cavity is provided on the shroud between the locating slot for the heat shield and the trailing edge of the blade airfoil for reducing the thermal and mechanical stresses in the region of transition between the trailing edge and shroud.

18 Claims, 3 Drawing Sheets

U.S. PATENT DOCUMENTS

| | | | | |
|---|---|---|---|---|
| 2004/0223846 | A1 | 11/2004 | Taylor et al. | |
| 2007/0269313 | A1 * | 11/2007 | Nadvit et al. | 416/193 A |

FOREIGN PATENT DOCUMENTS

| | | | |
|---|---|---|---|
| EP | 0 844 369 | A1 | 5/1998 |
| EP | 0 620 362 | B1 | 2/1999 |
| EP | 1 384 855 | A2 | 1/2004 |
| EP | 1 475 515 | A2 | 11/2004 |
| GB | 1 322 801 | | 7/1973 |
| JP | 11-050806 | A | 2/1999 |

OTHER PUBLICATIONS

Swiss Search Report dated Jul. 7, 2009 (with English language translation of category of cited documents).

Franz Joos et al., "Field Experience of the Sequential Combustion System for the ABB GT24/GT26 Gas Turbine Family", IGTI/ASME 98-GT-220, 1998, pp. 1-8, Stockholm.

* cited by examiner

GUIDE VANE FOR A GAS TURBINE

RELATED APPLICATIONS

This application claims priority as a continuation application under 35 U.S.C. §120 to PCT/EP2009/051969, which was filed as an International Application on Feb. 19, 2009 designating the U.S., and which claims priority to European Application 00417/08 filed in Europe on Mar. 19, 2008. The entire contents of these applications are hereby incorporated by reference in their entireties.

FIELD

The present disclosure relates to gas turbines. More particularly, the present disclosure relates to a stator blade for a gas turbine.

BACKGROUND INFORMATION

Gas turbines with sequential combustion are known and have proved to be successful in industrial use. Such a gas turbine, which has been known among experts as GT24/26, follows, for example, from an article by Joos, F. et al., "Field Experience of the Sequential Combustion System for the ABB GT24/GT26 Gas Turbine Family", IGTI/ASME 98-GT-220, 1998 Stockholm. In this document, FIG. 1 shows a basic construction of such a gas turbine. FIG. 1 of the Joos document is reproduced in the present disclosure as FIG. 1. Furthermore, such a gas turbine follows from EP-B1-0 620 362.

As shown in FIG. 1, the stator blades 10 of the known gas turbine have a blade airfoil 11 which extends in the longitudinal direction and which is delimited in the flow direction of a hot gas (parallel arrows in FIG. 1) by a leading edge 14 and a trailing edge 15. In the longitudinal direction, the blade airfoil 11 is delimited by a blade tip 13 and a cover plate 12 (sometimes also referred to as a shroud). The blade tip 13 delimits the annular hot gas passage of the turbine on the inner side and can adjoin the rotor shaft of the turbine via a sealing segment. The shroud 12, by its inner side 19, delimits the hot gas passage on the outside.

On the outer side of the shroud 12, which is exposed to throughflow by a cooling medium (for example, cooling air), a front and rear hook-like fastening element 16 or 17 are formed, which on the one hand serve for the fastening of the stator blade 10 on the inner casing of the turbine, and on the other hand are available for the locating and fixing of adjacent heat accumulation segments ("heat shields"; see FIG. 2, ref. no. 24) in the flow direction. For this purpose, on the rear fastening element 17, provision is made for a locating slot 18 into which a heat shield can be inserted. The locating slot 18 is delimited towards the shroud 12 by means of a horizontal base surface 18' which, together with the inclined inner side 19 of the shroud 12, forms a wedge-shaped section 19' in the region of the trailing edge 15, which section is characterized by a large material volume.

The transition 21 between the trailing edge 15 of the stator blade 10 and the shroud 12 represents a region for the service life of the stator blade 10, since a high thermal stress, which results from a thermal-mechanical mismatch between the shroud 12 and blade airfoil 11, is established within the region, wherein this leads to a peak in the mechanical stress, which results from the stress of the blade airfoil 11 which is impinged upon by the hot gas flow, being superimposed. The large material volume, which is mentioned above, in the wedge-shaped section 19' above the trailing edge 15 can lead to a significant increase of the thermal stresses in this region, which is important for the service life of the stator blade 10, and can therefore lead to a reduction of the service life itself, bearing in mind the fact that modern gas turbines require high temperatures with respect to operating fluids, which in many cases lie beyond the permissible material temperature of economically usable materials.

SUMMARY

An exemplary embodiment provides a stator blade for a gas turbine. The exemplary stator blade includes a blade airfoil which extends in the longitudinal direction of the stator blade and which is delimited by a leading edge and a trailing edge. The exemplary stator blade also includes a shroud. An inner side of the shroud is positioned for exposure to hot gas flowable through the gas turbine, and at least one hook-line fastening element projects outward in a region of the trailing edge on the shroud. The exemplary stator blade also includes at least one locating slot arranged above the trailing edge for fastening the stator blade on a casing or on elements of the gas turbine. In addition, the exemplary stator blade includes a cavity for reducing thermal and mechanical stresses in a region of transition between the trailing edge and the shroud. The cavity is provided on the shroud between the locating slot and the trailing edge of the blade airfoil.

An exemplary embodiment provides a stator blade. The exemplary stator blade includes a blade airfoil which extends in the longitudinal direction of the stator blade and which is delimited by a leading edge and a trailing edge. The exemplary stator blade also includes a shroud. An inner side of the shroud is positioned for exposure to hot gas flowable through the gas turbine, and at least one hook-line fastening element projects outward in a region of the trailing edge on the shroud. The exemplary stator blade also includes at least one locating slot arranged above the trailing edge for fastening the stator blade on a casing or on elements of a gas turbine. In addition, the exemplary stator blade includes a means for reducing thermal and mechanical stresses in a region of transition between the trailing edge and the shroud. The means for reducing thermal and mechanical stresses is provided on the shroud between the locating slot and the trailing edge of the blade airfoil.

BRIEF DESCRIPTION OF THE DRAWINGS

Additional aspects, features and advantages of the present disclosure shall subsequently be explained in more detail based on exemplary embodiments in conjunction with the drawings. All elements which are not essential for the direct understanding of the exemplary embodiments of the present disclosure have been omitted. Like elements are provided with the same designations in the different figures. The flow direction of the media is indicated by arrows. In the drawings.

DETAILED DESCRIPTION

Exemplary embodiments of the present disclosure provide a stator blade for gas turbines, in which extremely small and purposeful modifications in the design cause a significantly improved service life to be achieved.

According to an exemplary embodiment, provision is made for a cavity, on the shroud of the stator blade, between the locating slot for the heat shield and the trailing edge of the blade airfoil for reducing the thermal and mechanical stresses in the region of the transition between trailing edge and shroud. As a result of the material reduction which is achieved with the cavity directly on the shroud in the region of the trailing edge, the thermal and mechanical loads with regard to the service life of the blade can be very simply and efficiently improved.

According to an exemplary embodiment, the cavity has a circular boundary contour with a predefined diameter. The size of the diameter of the cavity is taken into account for limiting the stresses in the region of the cavity.

According to an exemplary embodiment, the cavity extends from the trailing edge of the shroud up to a predefined distance into the shroud. The ratio of the distance and the diameter of the cavity is taken into account for limiting the stresses in the region of the cavity.

According to an exemplary embodiment, a hook-like fastening element, which is located above the cavity, has a predefined length, which is measured from the locating slot for the heat shield. The ratio of the length of the fastening element and the diameter of the cavity is taken into account for limiting the stresses in the region of the cavity. The locating slot for the heat shield can have a height which corresponds approximately to a fifth of the length of the hook-like fastening element, for example.

The stator blade according to exemplary embodiments of the present disclosure can be used in a gas turbine, for example.

Figure 1:
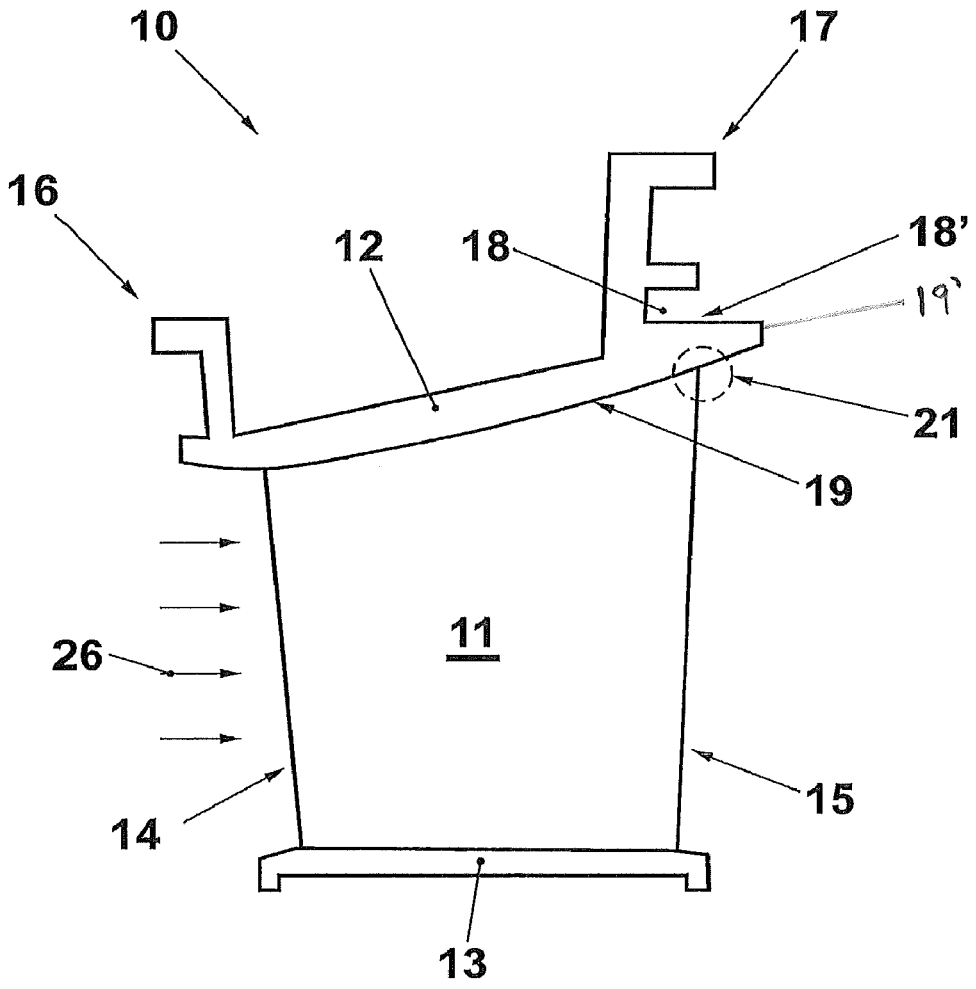
PRIOR ART FIG. 1
FIG. 1 shows in a side view a known stator blade, as has been installed in gas turbines.
Figure 2:
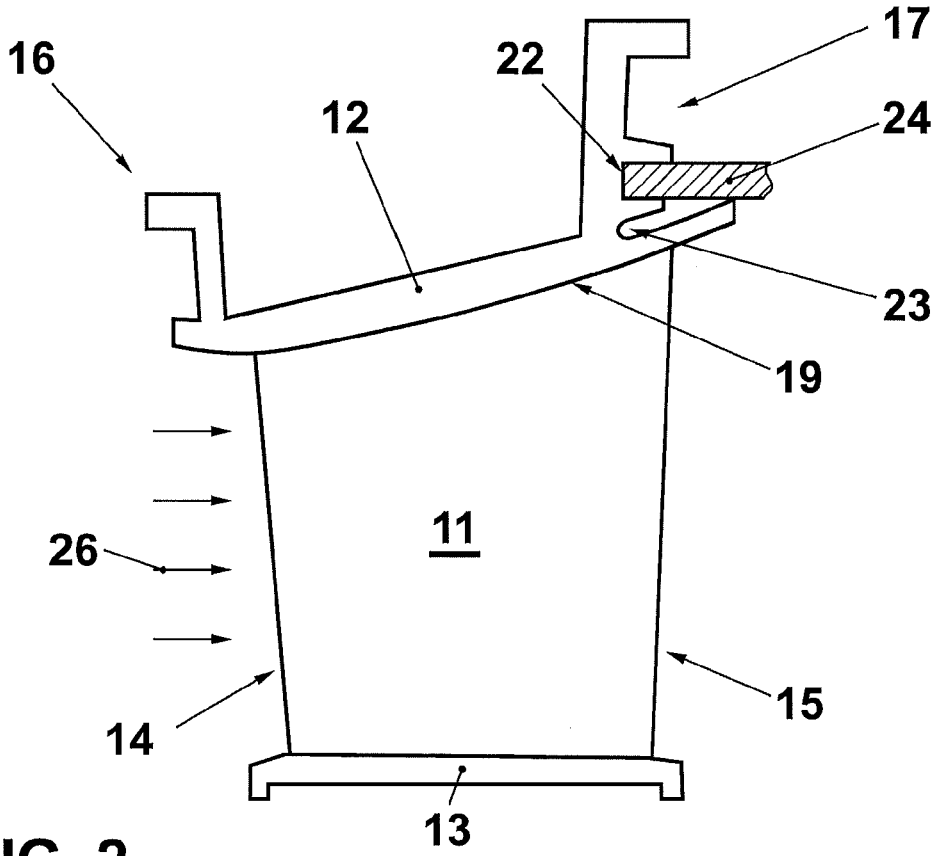
FIG. 2 shows, in a view which is comparable to FIG. 1, a stator blade according to an exemplary embodiment of the present disclosure.
Figure 3:
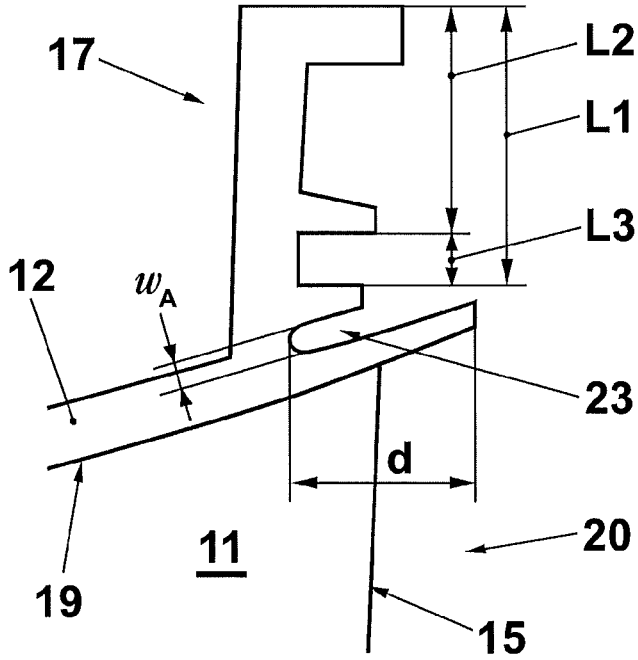
FIG. 3 shows an enlarged detail from FIG. 2 with an exemplary transition from the trailing edge of the blade airfoil to the rear fastening element of the stator blade.
Figure 4:
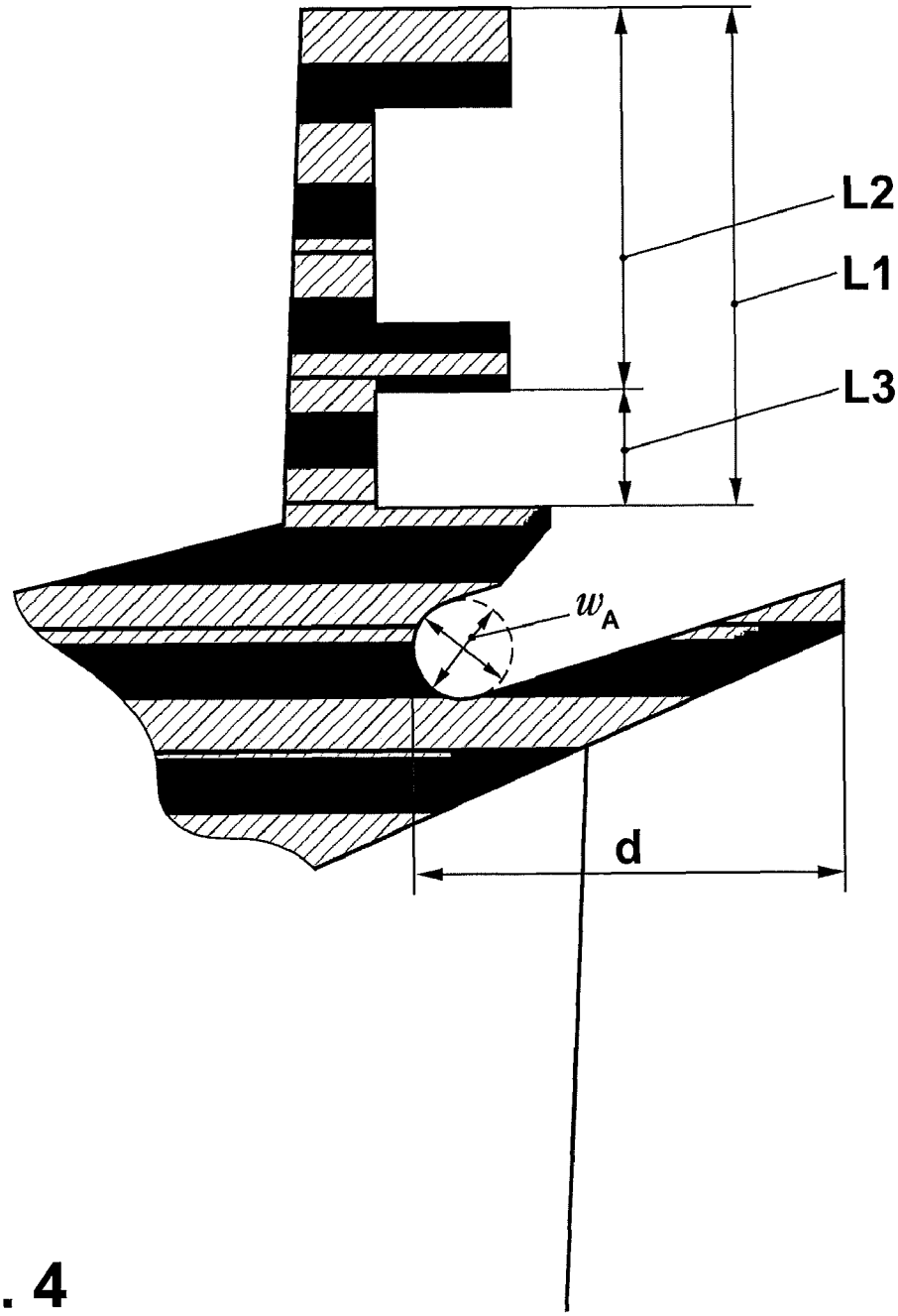
FIG. 4 shows an enlarged partial view of a fastening element in a region of the cavity, according to an exemplary embodiment of the present disclosure.

In FIGS. 2 and 3, in a view which is comparable to FIG. 1, a stator blade according to an exemplary embodiment of the present disclosure is shown. FIG. 3 and FIG. 4, which illustrates an enlarged view of a fastening element, provide further illustration of the configuration of a cavity arranged in the stator blade. The stator blade 20 includes a blade airfoil 11 having a leading edge 14 and a trailing edge 15. The blade airfoil 11 is delimited in the longitudinal direction by a blade tip 13 and a shroud 12. According to the illustrated exemplary embodiment, the shroud 12 has an inner side 19 which is inclined at an angle in the outwards direction in the direction of flow. Hook-like fastening elements 16 and 17 are formed on the outer side of the shroud 12, wherein a locating slot 22 for an adjoining heat shield 24 is formed on the rear fastening element 17 on the rear side.

A cavity 23 is provided for reducing the thermal and/or mechanical stresses between the trailing edge 15 of the blade airfoil 11 and the shroud 12. The cavity 23 is provided beneath the locating slot 22 and extends from the trailing edge 25 of the shroud 12, which leads to a significant reduction of the thickness and therefore of the material volume of the shroud 12 in the region above the trailing edge 15. The cavity 23 is delimited at its inner end by means of a circular boundary contour with a predefined diameter $w_A$. Measured from the trailing edge 25 of the shroud 12, the cavity 23 extends up to a distance d into the shroud 12 (see FIGS. 3 and 4). According to an exemplary embodiment, means for reducing the thermal and/or mechanical stress can, for example, include the cavity 23 which is introduced into the shroud 12 beneath the locating slot 22.

The length of the rear hook-like fastening element 17 from the underside of the locating slot 22 to the outer end is designated L1. This length L1 can be divided into the height L3 of the locating slot 22 and the remaining length L2, so that L3 corresponds approximately to one fifth of L1, while L2 constitutes about four fifths of L1, for example.

The two values d and L1 are two of the influencing values upon the forces in the cavity 23. The ratios $d/w_A$ and also $L1/w_A$ play a role in this case. A $d/w_A$ and $L1/w_A$ which are too large would drive the stresses upwards; therefore WA should react as a substantial value. Accordingly, if the values d and L1 should be too large with regard to the stresses which occur at the cavity 23, the diameter $w_A$ of the cavity 23 is selected correspondingly larger in order to reduce the aforesaid ratio numbers to a tolerable level. In this way, design freedom is gained in the construction of the shroud 12 without the stresses increasing and leading to a reduction of the service life.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10, 20 Stator blade (gas turbine)
11 Blade airfoil
12 Shroud
13 Blade tip
14 Leading edge
15 Trailing edge (blade airfoil)
16, 17 Fastening element (hook-like)
18, 22 Locating slot (heat shield)
18' Base surface (locating slot)
19 Inner side (outer shroud)
20 Transition (trailing edge to outer shroud)
21 Cavity
22 Heat shield
23 Trailing edge (outer shroud)
24 Hot gas
25 d Distance
L1, L2, L3 Length
$w_A$ Diameter

What is claimed is:

1. A stator blade for a gas turbine, comprising:

a blade airfoil which extends in the longitudinal direction of the stator blade and which is delimited by a leading edge and a trailing edge;

a shroud, an inner side of which is positioned for exposure to hot gas flowable through the gas turbine, and on which at least one hook-like fastening element projects outward in a region of the trailing edge;

at least one locating slot arranged above the trailing edge for fastening the stator blade on a casing or on elements of the gas turbine; and a cavity for reducing thermal and mechanical stresses in a region of transition between the trailing edge and the shroud, the cavity being provided on the shroud between the locating slot and the trailing edge of the blade airfoil.

2. The stator blade as claimed in claim 1, wherein the locating slot is arranged above the cavity for fixing a heat shield, which is connected to the shroud of the stator blade, in a flow direction of the hot gas.

3. The stator blade as claimed in claim 1, wherein:

the cavity has a circular boundary contour with a predefined diameter; and an amount of stresses limited in the region of the cavity is proportional to a size of the diameter of the cavity.

4. The stator blade as claimed in claim 3, wherein:

the cavity extends from the trailing edge of the shroud up to a predefined distance into the shroud; and an amount of stresses limited in the region of the cavity is proportional to a ratio of the distance and of the diameter of the cavity.

5. The stator blade as claimed in claim 4, wherein:

the hook-like fastening element being located above the cavity has a predefined length, measured from the locating slot for the heat shield; and an amount of stresses limited in the region of the cavity is proportional to a ratio of the length of the fastening element and the diameter of the cavity.

6. The stator blade as claimed in claim 5, wherein the locating slot for the heat shield has a height which corresponds to approximately one fifth of the length of the hook-like fastening element.

7. The stator blade as claimed in claim 3, wherein:

the hook-like fastening element being located above the cavity has a predefined length, measured from the locating slot for the heat shield; and an amount of stresses limited in the region of the cavity is proportional to a ratio of the length of the fastening element and the diameter of the cavity.

8. The stator blade as claimed in claim 7, wherein the locating slot for the heat shield has a height which corresponds to approximately one fifth of the length of the hook-like fastening element.

9. A gas turbine comprising a stator blade as claimed in claim 1.

10. The gas turbine according to claim 9, wherein the gas turbine is configured to cause sequential combustion.

11. A stator blade comprising:

a blade airfoil which extends in the longitudinal direction of the stator blade and which is delimited by a leading edge and a trailing edge;

a shroud, an inner side of which is positioned for exposure to hot gas flowable through the gas turbine, and on which at least one hook-like fastening element projects outward in a region of the trailing edge;

at least one locating slot arranged above the trailing edge for fastening the stator blade on a casing or on elements of a gas turbine; and means for reducing thermal and mechanical stresses in a region of transition between the trailing edge and the shroud, the means for reducing thermal and mechanical stresses being provided on the shroud between the locating slot and the trailing edge of the blade airfoil.

12. The stator blade as claimed in claim 11, wherein the locating slot is arranged above the means for reducing thermal and mechanical stresses, for fixing a heat shield, which is connected to the shroud of the stator blade, in a flow direction of the hot gas.

13. The stator blade as claimed in claim 11, wherein:

the means for reducing thermal and mechanical stresses has a circular boundary contour with a predefined diameter; and an amount of stresses limited in the region of the means for reducing thermal and mechanical stresses is proportional to a size of the diameter of the cavity.

14. The stator blade as claimed in claim 13, wherein:

the means for reducing thermal and mechanical stresses extends from the trailing edge of the shroud up to a predefined distance into the shroud; and an amount of stresses limited in the region of the means for reducing thermal and mechanical stresses is proportional to a ratio of the distance and of the diameter of the cavity.

15. The stator blade as claimed in claim 14, wherein:

the hook-like fastening element being located above the means for reducing thermal and mechanical stresses has a predefined length, measured from the locating slot for the heat shield; and an amount of stresses limited in the region of the means for reducing thermal and mechanical stresses is proportional to a ratio of the length of the fastening element and the diameter of the cavity.

16. The stator blade as claimed in claim 15, wherein the locating slot for the heat shield has a height which corresponds to approximately one fifth of the length of the hook-like fastening element.

17. The stator blade as claimed in claim 13, wherein:

the hook-like fastening element being located above the means for reducing thermal and mechanical stresses has a predefined length, measured from the locating slot for the heat shield; and an amount of stresses limited in the region of the means for reducing thermal and mechanical stresses is proportional to a ratio of the length of the fastening element and the diameter of the cavity.

18. The stator blade as claimed in claim 17, wherein the locating slot for the heat shield has a height which corresponds to approximately one fifth of the length of the hook-like fastening element.

* * * * *